United States Patent [19]

Isaacson

[11] 3,991,523

[45] *Nov. 16, 1976

[54] VIBRATORY APPARATUS WITH IMPROVED MOTOR ACTUATED DOOR MECHANISM FOR CLOSING THE DISCHARGE OUTLET

[75] Inventor: Max Isaacson, Dayton, Ohio

[73] Assignee: Vibrodyne, Inc., Dayton, Ohio

[ * ] Notice: The portion of the term of this patent subsequent to Mar. 18, 1992, has been disclaimed.

[22] Filed: Feb. 4, 1975

[21] Appl. No.: 547,047

Related U.S. Application Data

[63] Continuation-in-part of Ser. No. 450,975, March 14, 1974, Pat. No. 3,871,136.

[52] U.S. Cl. ..... 51/163.1; 49/343

[51] Int. Cl.[2] ..... B24B 31/06

[58] Field of Search ..... 49/340, 343; 51/163

[56] References Cited

UNITED STATES PATENTS

| | | | |
|---|---|---|---|
| 2,316,309 | 4/1943 | Blain | 49/340 |
| 2,540,538 | 2/1951 | Matchett | 49/340 |
| 2,594,643 | 4/1952 | Gustisha | 49/343 X |
| 2,738,972 | 4/1956 | Morris | 49/343 X |
| 2,768,532 | 10/1956 | Russell | 49/340 X |
| 2,924,449 | 2/1960 | Leimer | 49/340 X |
| 3,643,384 | 2/1972 | Isaacson | 51/163 |

*Primary Examiner*—Harold D. Whitehead
*Attorney, Agent, or Firm*—Jacox & Meckstroth

[57] ABSTRACT

An open top tub or container is supported for vibration and is adapted to receive a workload of treating media and parts to be treated. The container is vibrated by variable power operated means and includes an end wall having an outlet for removing the workload from the container. The outlet is closed by a door member which is pivotally supported for movement between a closed position and a retracted open position in response to operation of a reversible electric motor. The motor drives a positive drive mechanism which includes a gear reducer connected to an elongated screw which extends through a rotatable nut member connected to the door member. Preferably, the drive mechanism has a high mechanical advantage, and the motor may consist of a DC motor which has a permanently magnetized stator and which is adapted to be continuously energized so that a continuously applied force holds the door member closed while the container and work load are vibrating. A water-tight seal is formed around the door by a resilient seal which contacts an outwardly projecting annular bead.

2 Claims, 5 Drawing Figures

VIBRATORY APPARATUS WITH IMPROVED MOTOR ACTUATED DOOR MECHANISM FOR CLOSING THE DISCHARGE OUTLET

RELATED APPLICATION

This application is continuation-in-part of application Ser. No. 450,975, filed Mar. 14, 1974, now issued as U.S. Pat. No. 3,871,136.

BACKGROUND OF THE INVENTION

In a vibratory machine or apparatus such as disclosed in Isaacson et al. U.S. Pat. No. 3,173,664, it is common to provide a discharge outlet within one or both ends of the open top tub or container to provide for conveniently removing the workload of parts and media after the parts have been finished or treated. Usually, the discharge outlet is closed during the vibratory treating process by means of a door member which is locked by a hand actuated toggle latch, for example, as disclosed in Isaacson et al. U.S. Pat. No. 3,643,384 which issued to the assignee of the present invention. Another means for opening and closing the door member is disclosed in Isaacson et al. U.S. Pat. No. 3,694,968 which also issued to the assignee of the present invention. In this patent, the door opening and closing means consist of a fluid actuated rotary motor which moves a linkage system connected to the door.

Since the door member is usually supported by the adjacent end wall of the container, and the door member and its locking or actuating mechanism vibrate with the container, it is highly desirable to minimize the mass of the door and its actuating mechanism. It is also desirable for the door actuating mechanism to be rugged and durable in construction so that it can withstand the vibration for a substantial period of time, and also for the mechanism to be electrically actuated so that the operation of the door member between its closed and open positions can be automatically controlled in a simple manner from an electrical control box or panel. It has also been found important for the door actuating mechanism to provide for holding the door member in its closed position with a continuously applied force to prevent a leak from developing when the container and the door member are being vibrated during treatment of the parts.

SUMMARY OF THE INVENTION

The present invention is directed to an improved automatically operated door system for closing the discharge outlet of a vibratory machine which is used for treating a supply of parts. The door system provides all of the desirable features mentioned above and, in accordance with a preferred embodiment, incorporates a reversible D.C. motor and a positive rotary drive mechanism including a gear reducer unit which drives an elongated screw. The screw is threaded into a nut member which is supported by a set of arms secured to a circular door member. The arms also support the door member for pivotal movement between its closed and open positions. The D.C. motor incorporates a permanently magnetized stator and requires only a very small current so that the motor may be continuously energized to apply a constant force against the door member in its open and closed positions. The drive mechanism also has a high mechanical advantage so that when the motor is deenergized, the mechanism does not reverse, and the positive force is maintained.

This constant force minimizes relative vibration between the door member and the adjacent end wall of the container in the open position and between the door member and the discharge opening in its closed position to assure a fluid-tight seal between the door member and the container.

Other features and advantages of the invention will be apparent from the following description, the accompanying drawings and the appended claims.

DESCRIPTION OF THE PREFERRED EMBODIMENT

Figure 1:
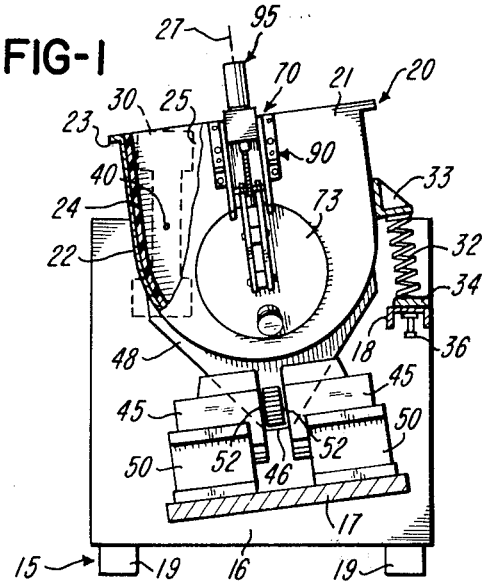
FIG. 1 is an end elevational view of a vibratory machine incorporating a door system constructed in accordance with the present invention, and with portions of the machine broken away to show internal construction.

The vibratory machine or apparatus shown in the drawing generally includes a base frame 15 having parallel spaced vertical end walls 16 rigidly connected by cross members including a cross plate 17 and a channel member 18. The frame 15 is mounted on resilient shock absorbing feet 19 located at the corners of the frame. An open top trough-like tub or container 20 is positioned between the end walls 16 of the frame 15 and includes parallel spaced vertical end walls 21 which are rigidly connected by an intermediate wall 22 having a U-shaped cross-sectional configuration. The container 20 has an outwardly projecting peripheral flange 23, and the walls 21 and 22 are covered with a durable polyurethane lining 24 having ribs defining a corrugated inner surface.

The lined container walls 21 and 22 define an open top chamber 25 having a rectangular horizontal configuration and a U-shaped vertical configuration. The chamber 25 is adapted to receive a workload, for example, a media of ceramic chips or other abrasive materials and a suspended batch of parts which are to be surface finished such as by a deburring, polishing or descaling operation. The container 20 is positioned so that a longitudinal plane 27 extending through the center of the chamber 25, is slightly inclined from a vertical plane.

The container 20 is supported on one side of the center plane 27 by a pair of I-shaped spring beams 30 which connect the end walls 21 of the container to the end walls 16 of the frame 15. On the opposite side of the center plane 27, the container 20 may be supported by a plurality of longitudinally spaced coil compression springs 32 which extend between the frame channel 18 and a longitudinally extending angle bracket 33 secured to the adjacent side of the intermediate wall 22 of the container. The lower end of each coil spring 32 seats on a fitting 34 supported by the upper end of a screw 36 which can be adjusted to vary the upward force exerted by the spring on the container 20.

The spring beams 30 establish an effective pivot axis 40 for the container 20 and cooperate with the springs 32 to provide the container 20 with a predetermined resonant frequency of oscillation. This resonant frequency is in the neighborhood of and generally above 3600 cycles per second when the apparatus is to be operated from a 60 cycle power supply. After the load is placed within the container 20, the coil springs 32, when used, are adjusted so that the resonant frequency of the system including the container, load, spring beams and coil springs, is substantially 3600 cycles per second.

The container 20 is preferably oscillated by power operated means including a pair of electromagnets 45 arranged in opposing relation on opposite sides of a bar-like armature 46 that is rigidly connected to the tub. The ends of the armature are rigidly connected to parallel spaced plates 48 which are secured to the intermediate wall 22 of the container 20. Each magnet 45 is mounted on a bracket 50 which is slidably supported by the cross plate 17 and is laterally adjustable by a set of screws (not shown). Each magnet 45 is adjusted after the container is loaded to a predetermined value to form a predetermined uniform gap 52 between the armature 46 and each of the electromagnets 45 according to the desired amplitude of oscillation. When the actual load is placed within the container 20 and it is greater than the predetermined value, the armature 46 will move closer to the magnet 45 on the left (FIG. 1). The coil springs 45 are then adjusted to return the armature to a position substantially centered between the magnets.

Figure 3:
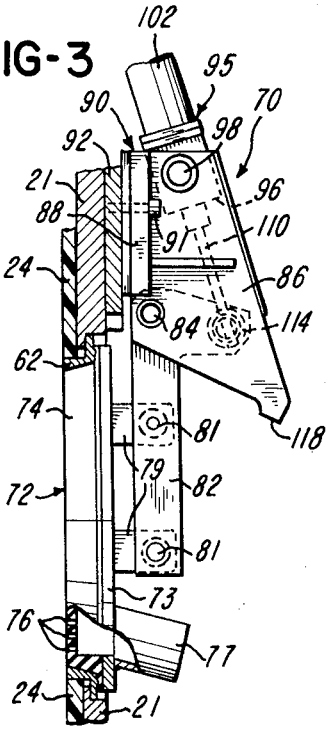
FIG. 3 is a side elevational view of the door with a portion shown in section, and illustrating the door system in its closed position.
Figure 4:
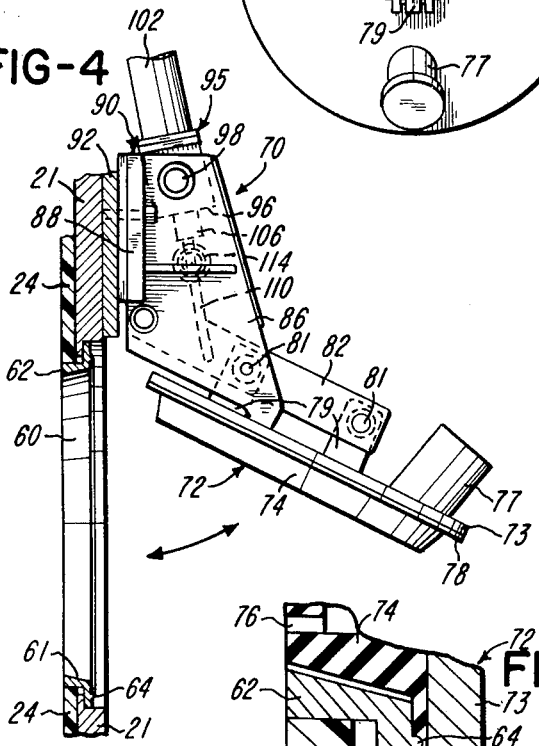
FIG. 4 is a view similar to FIG. 3 and illustrating the door system in its open position.

As shown in FIGS. 3 and 4, one of the end walls 21 of the container 20 is provided with a circular discharge outlet 60 which is defined by a frusto-conical surface 61 of a rigid metal ring 62 having an outwardly projecting flange portion 63 rigidly secured to the end wall 21. The flange portion 63 of the ring 62 includes an axially or outwardly projecting annular rib or bead 64. In accordance with the present invention, the discharge of media and treated parts through the outlet 60 is controlled by a closure mechanism or door system 70 which includes a circular door member 72 incorporating a flat circular metal plate 73.

Figure 5:
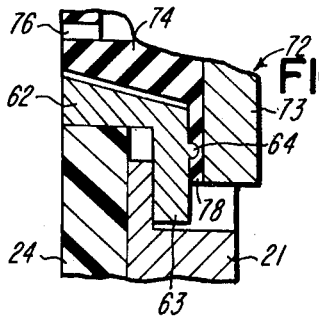
FIG. 5 is an enlarged fragmentary section of the door member in its closed position and showing the seal formed within the container.

The plate 73 carries a plug member 74 which is cast of urethane and has a frusto-conical outer surface adapted to extend adjacent the surface 61 when the door member 72 is in its closed position (FIG. 3). The plug member 74 is provided with a series of small drainage holes 76 so that liquid may be removed from the chamber 25 through a conduit 77 projecting outwardly from the door plate 73. The plug member 74 includes an outwardly projecting flange portion 78 (FIG. 5) which is also secured to the plate 73 and engages the annular bead 64 when the door member 72 is closed. Instead of the bead 64 being formed as a part of flange 63 it may be made as a part of the plate 73.

Figure 2:
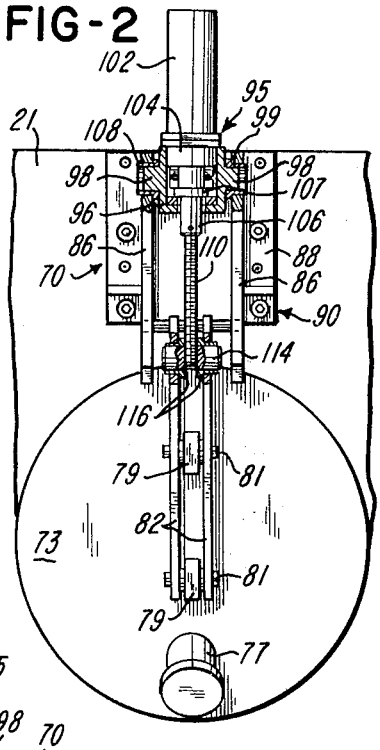
FIG. 2 is an enlarged elevational view of the door system shown in FIG. 1.

A pair of spaced lugs 79 (FIGS. 2 and 3) project outwardly from the metal door plate 73 and are connected by a set of cross pins 81 to a pair of parallel spaced L-shaped arm members 82. The arm members 82 are pivotally supported by a cross pin 84 which extends through parallel spaced members or plates 86 rigidly connected by a base plate 88. The plates 86 and 88 cooperate to form a mounting bracket 90 which is rigidly secured by a set of screws 91 to a plate 92 mounted on the adjacent end wall 21 of the container 20.

The parallel spaced bracket plates 86 also support a motor-gear reducer unit 95 which projects into a tubular housing 96 positioned between the plates 86. The housing 96 includes a pair of diametrically opposed cylindrical trunions 98 which project outwardly into corresponding tubular bushings 99 retained within corresponding holes in the bracket plates 86. The trunions 98 provide for pivotal movement of the motor-gear reducing unit 95 on an axis extending parallel to the adjacent end wall 21 the container 20.

Preferably, the unit 95 includes a direct current motor 102 which has a permanently magnetized stator and a relatively high shaft speed, for example, 4000 r.p.m. The output shaft of the motor 102 drives a gear reducer 104 which provides a reduction of approximately 30 to 1. The output shaft of the gear reducer is splined and drives a tubular female splined coupling 106 having an outwardly projecting flange 107 which has a an inner face engaging an antifriction thrust bearing 108 confined within the housing 96. The coupling 106 connects the output shaft of the gear reducer 104 to one end portion of an elongated screw 110. Thus when the motor 102 is energized, the coupling 106 and screw 110 are driven at a speed of approximately 133 r.p.m.

The outer end portion of the screw 110 is threaded into a hole extending radially through a cylindrical nut member 114 which is rotatably supported by a set of bushings 116 confined within corresponding holes in the arm plates 82. Thus when the electric motor 102 is actuated in one direction, it is effective to move the door member 72 towards its closed position (FIG. 3) wherein the resilient flange portion 78 of the plug member 74 firmly engages the annular bead 64 and forms a positive fluid-tight seal between the door member 72 and the adjacent end wall 21 of the container 20. When the motor 102 is operated in the opposite or reverse direction, the door member 72 is moved or pivoted to its open position (FIG. 4) where the metal plate 74 firmly engages the stop surfaces 118 formed on the outer end portions of the bracket plates 86. In its open position, the door member 72 provides for the discharge of the workload of treating media and treated parts from the tub chamber 25. The treated parts are then separated from the treating media, for example, by a vibratory screen, and the media is returned to the chamber 25 for receiving the next batch of parts to be treated.

From the drawing and the above description, it is apparent that a vibratory machine or apparatus incorporating a closure mechanism or door system constructed in accordance with the invention, provides desirable features and advantages. One important feature is provided by the relative low mass of the motor-gear reducer unit 95 and the support bracket 90. Since these components are supported directly by the vibratory tub or container 20 along with the door member 72, their low mass reduces the electrical power required by the electromagnets 45 for vibrating or oscillating the assembly of the container 20 and the door system 70 and also maintains a minimum of relative vibration between the door member and its supporting structure.

Another important feature is provided by the small electrical power required to operate the reversible D.C. motor 102 for opening and closing the door member 72. That is, because the small electrical power required by the motor 102, the motor may be continuously energized in a stalled condition so that a continuing force is exerted on the door member 72 to hold the door member in its closed position while the container 20 is being vibrated. In addition, when the door member is moved to its open position (FIG. 4), the motor 102 may remain energized and in a stalled condition so that the door member 72 is held against the stop surfaces 118 with a continuously applied force and thereby avoid vibration of the door member 72 relative to the support bracket 90 and the container 20.

As another feature, the gear reducer 104 and the combined screw 110 and the nut member 114 individually and collectively have a high mechanical advantage so that this drive mechanism and the motor do not automatically reverse or are not vibrated in a reverse direction in any position of the door member when the motor 102 is deenergized. Thus the motor and the drive mechanism cooperate to compensate automatically for wear of the movable components of the door mechanism and also for wear of the resilient door seal, and thereby always assure a positive fluid-tight closure for the outlet.

The direct electrical actuation of the reversible motor 102 also provides for conveniently automating the operation of the closure mechanism 70 so that it may be actuated from a remote control box or panel which also controls the batch supply of parts and the return of media to the container 20. As a result, a completely automated cycle may be provided. It is also within the scope of the invention to position a small control switch on the door member 72 for sensing the pressure exerted by the door plate 73 and the resilient flange 78 against the flange 63 of the ring 62 when the door member is closed. When the pressure exceeded a predetermined value, the switch would deenergize the motor 102.

While the form of vibratory apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In vibratory apparatus including a frame, a vibratory container defining a chamber adapted to receive a load of media and parts to be vibrated, means mounted on said frame and supporting said container for vibration, power operated means for vibrating said container with sufficient force to effect movement of the load within said chamber, said container having a wall defining an outlet to provide for the discharge of treated parts from said chamber, a door member, means supporting said door member for pivotal movement between a closed position forming a closure for said outlet and an open position spaced from said outlet, an improved system for actuating said door member, comprising a reversible electric motor including a permanently magnetized stator, a rotary drive mechanism driven by said motor and connected to move said door member between said open and closed positions in response to operation of said motor, means mounted on said vibratory container and supporting said motor and said drive mechanism for pivotal movement as a unit on an axis spaced parallel and above the pivot axis of said door member, means forming a stop surface for engaging said door member in said open position, and said motor and said drive mechanism cooperate to hold said door member against said container wall in said closed position and against said stop surface in said open position in response to actuation of said motor.

2. Vibratory apparatus as defined in claim 1 wherein said means supporting said door member include a bracket member having a set of generally parallel spaced support members, said motor is positioned generally between said support members, an arm member secured to said door member and extending between said support members, and means on said support members for pivotally supporting said arm member.

* * * * *